US007951018B2

(12) United States Patent
Caya

(10) Patent No.: US 7,951,018 B2
(45) Date of Patent: May 31, 2011

(54) GOLF TEE AND METHOD OF MAKING SAME

(75) Inventor: Mario Caya, Perth (CA)

(73) Assignee: Mario Caya, Perth (CA)

( * ) Notice: Subject to any disclaimer, the term of this patent is extended or adjusted under 35 U.S.C. 154(b) by 154 days.

(21) Appl. No.: 11/867,780

(22) Filed: Oct. 5, 2007

(65) Prior Publication Data

US 2009/0093323 A1 Apr. 9, 2009

(51) Int. Cl.
*A63B 57/00* (2006.01)

(52) U.S. Cl. ..... 473/387; 473/390

(58) Field of Classification Search ..... 473/387–403, 473/579, 580, 280, 281; D21/717–719; 273/DIG. 20

See application file for complete search history.

(56) References Cited

U.S. PATENT DOCUMENTS

| | | | | | |
|---|---|---|---|---|---|
| 1,554,321 | A | * | 9/1925 | Banigan | 473/388 |
| 1,823,992 | A | * | 9/1931 | Smith | 473/396 |
| 3,560,128 | A | * | 2/1971 | Carlton | 473/579 |
| 3,690,676 | A | * | 9/1972 | Costa | 473/398 |
| 3,697,082 | A | * | 10/1972 | Di Laura et al. | 473/388 |
| 3,831,943 | A | * | 8/1974 | Popplewell | 473/579 |
| 3,993,310 | A | * | 11/1976 | Popplewell | 473/579 |
| 4,101,128 | A | * | 7/1978 | Yellen | 473/459 |
| 4,776,596 | A | * | 10/1988 | Nojima | 473/281 |
| 4,943,055 | A | * | 7/1990 | Corley | 473/451 |
| 5,033,747 | A | * | 7/1991 | Young | 473/391 |
| D337,364 | S | * | 7/1993 | Piper et al. | D21/717 |
| 5,242,161 | A | | 9/1993 | Wilkirson | |
| 5,356,146 | A | | 10/1994 | Blosser | |
| 5,421,587 | A | * | 6/1995 | Mao-Huang | 473/579 |
| 5,569,102 | A | * | 10/1996 | Karron | 473/401 |
| D382,928 | S | | 8/1997 | Bess | |
| 6,110,060 | A | * | 8/2000 | Spoto | 473/396 |

(Continued)

FOREIGN PATENT DOCUMENTS

JP 2005/065945 3/2005

(Continued)

OTHER PUBLICATIONS

UK Search Report issued Oct. 31, 2008—3 pages.

(Continued)

*Primary Examiner* — Steven Wong
(74) *Attorney, Agent, or Firm* — Summa, Additon & Ashe, P.A.

(57) ABSTRACT

A golf tee is provided for supporting a golf ball. The golf tee is adapted to sit on top of the ground and comprises a support rim or at least three support points for supporting a golf ball and an open body having a lower end suitable for placement on the ground and an upper end suitable for connection to the support rim. An optional neck may be used connecting the upper end of the open body to the support rim. The open body comprises a plurality of support columns and optionally one or more support rings connecting the support columns. The support columns are separated by holes thereby increasing the surface area of the golf tee. The open body and holes are adapted to receive grass and can allow for substantial level placement of the tee relative to the ground even when the grass is dense or longer. The support columns and holes result in a golf tee having a high drag and relatively low weight thereby providing a golf tee which travels a relatively short distance when struck by a swinging golf club.

6 Claims, 4 Drawing Sheets

U.S. PATENT DOCUMENTS

| | | | | |
|---|---|---|---|---|
| 6,152,837 | A | 11/2000 | Reid | |
| 6,200,233 | B1 * | 3/2001 | Moody | 473/398 |
| D461,216 | S * | 8/2002 | Luther, Sr. | D21/791 |
| 6,475,107 | B1 * | 11/2002 | Sand | 473/398 |
| 6,508,728 | B1 | 1/2003 | Colletti | |
| 7,094,163 | B2 | 8/2006 | Lu et al. | |
| D533,241 | S * | 12/2006 | Calhoon et al. | D21/717 |
| D576,236 | S * | 9/2008 | Kelley | D21/717 |
| 2004/0067802 | A1 * | 4/2004 | Salsman | 473/387 |
| 2004/0185967 | A1 * | 9/2004 | McDonough et al. | 473/387 |
| 2005/0233838 | A1 | 10/2005 | Kahl | |

FOREIGN PATENT DOCUMENTS

| | | |
|---|---|---|
| WO | WO2007/105379 | 9/2007 |

OTHER PUBLICATIONS

NZ Examination Report issued Oct. 9, 2008—2 pages.

* cited by examiner

GOLF TEE AND METHOD OF MAKING SAME

FIELD OF THE INVENTION

The invention relates to golf equipment and specifically to a golf tee for teeing a golf ball.

BACKGROUND OF THE INVENTION

In the game of golf, a golf tee is commonly used to tee a golf ball for the first shot of a hole. Typically, the golf tee supports the golf ball and elevates the golf ball above the ground to thereby provide an improved lie for better contact between the golf club that the golfer is using and the golf ball.

It is desirable to be able to tee the golf ball to various heights depending on the type of golf club being used, the distance that the golfer is attempting to hit the golf ball, the lie, the style of golf swing, etc. Typically this has been done by providing a wooden golf tee having a shaft suitable for penetrating the ground and a cup suitable for supporting the golf ball. The golf tee is sunk into the ground the desired amount and the ball is placed on the golf tee. A problem with this type of tee is pushing the tee precisely into the ground the exact same desired distance in order to replicate a consistent elevation every time and for each golf club a golfer may use. Another problem with this type of golf tee is that it can easily be broken during impact by the golf club as it is stuck into the ground. Additionally, this type of golf tee provides little aerodynamic resistance and can therefore travel through the air a long distance as a result of being struck by the golf club. As such, typical golf tees are easily lost or broken and a golfer will often have to replace the tee many times during a round of golf. This also contributes to the pollution over time of the golf course.

One attempt at overcoming this problem is provided by a golf tee which sits on top of the ground as opposed to being sunk into the ground. This reduces the risk of breakage at impact as the golf tee is simply propelled when impacted by the golf club. However, this type of golf tee is propelled a long distance and can be lost. Additionally, adjustment of the height of the golf ball is not possible. One type of tee adapted to sit on top of the ground is a brush tee where the ball is supported by a plurality of bristles. However, the bristles are gradually bent during repeated use making it impossible to properly support a golf ball without replacing the brush tee.

A need therefore exists for an improved golf tee for supporting a golf ball.

SUMMARY OF THE INVENTION

A golf tee is provided for supporting a golf ball. The golf tee is designed to sit on top of the ground or any hard surface and comprises a support rim or points for supporting a golf ball, an open body having a lower end suitable for placement on the ground and an upper end suitable for connection with the support rim. An optional neck may be used, connecting the upper end of the open body to the support rim. The open body comprises a plurality of support columns and may further optionally comprise one or more support rings connecting the support columns, giving the golfer various tee height options. The support columns are separated by holes thereby increasing the surface area of the golf tee. The open body and holes are adapted to receive grass and can allow for substantial level placement of the tee relative to the ground even in when the grass is dense or longer. Additional mesh or webbing may optionally be included between the columns to further increase surface area of the tee and as a result increase the drag of the tee. The support columns, holes and optional webbing or mesh result in a golf tee having a high drag and relatively low weight thereby providing a golf tee which travels a relatively short distance when struck by a swinging golf club. Further, as the golf tee sits on top of the ground and is not sunk into the ground, the tendency for the golf tee to break is reduced. The golf tee may be made from a recycled or modified shuttlecock.

In one embodiment there is provided a golf tee comprising:
- a support rim for supporting a golf ball; and
- an open body having a lower end for supporting the golf tee and an upper end connected to the support rim; the body comprising:
  - a plurality of support columns; and
  - a plurality of holes between the support columns.

The golf tee may further optionally comprise a neck and/or one or more support rings connecting the support columns.

In another embodiment there is provided a golf tee kit comprising:
- a plurality of golf tees, each golf tee having a different height and comprising:
  - a support rim for supporting a golf ball; and
  - an open body having a lower end for supporting the golf tee and an upper end connected to the support rim; the body comprising:
    - a plurality of support columns; and
    - a plurality of holes between the support columns.

The golf tees of the kit may further optionally comprise a neck and/or one or more support rings connecting the support columns.

In another embodiment there is provided a method of making a golf tee from a shuttlecock comprising the step of:
- removing the elastomeric base from the shuttlecock leaving a shuttlecock body and optionally trimming a lower end and/or an upper end of the shuttlecock body to reduce the height to a desired height for a user.

DETAILED DESCRIPTION OF THE INVENTION

Figure 1:
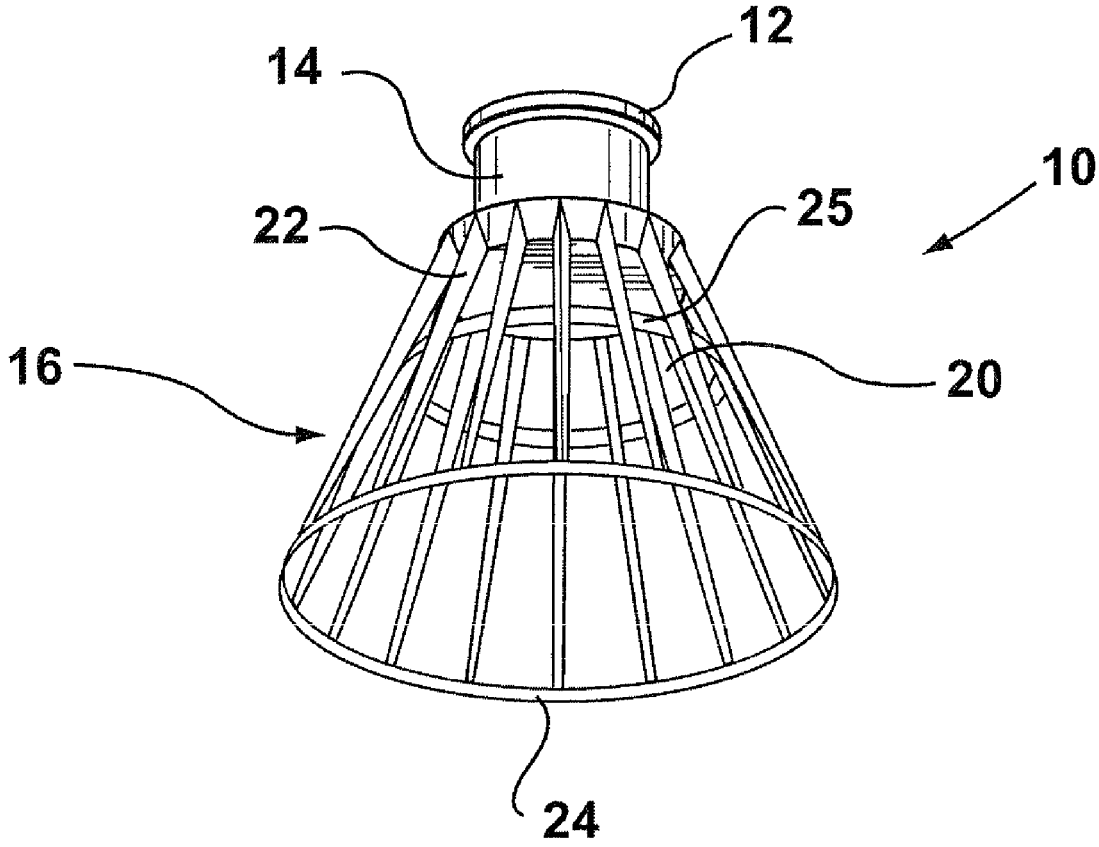
FIG. 1 is a perspective view illustrating one embodiment of a golf tee having a conical body.

FIG. 1 is a perspective view illustrating one embodiment of a golf tee shown generally as 10. The golf tee 10 has a support rim 12 for supporting a golf ball (not shown) to be hit by a golfer. The golf tee 10 also has an open conical body 16. The body 16 has a lower end suitable for placement on the ground. The body 16 is formed of a number of supporting columns 22 which may be either directly connected to the support rim 12 or may connect to an optional neck 14 which supports the support rim 12. An optional lower rim 24 may be used, connecting the lower end of the supporting columns 22. Alternatively, no lower rim may be used and the tee 10 may sit directly on the lower end of the support columns 22. A plurality of holes 20 separate the columns and reduce the overall weight of the tee 10. As a result, the surface area of the tee 10 is relatively high thereby causing the tee 10 to have a high drag. Additionally, the use of the holes 20 causes the tee 10 to have a low weight and decreases the weight to drag ratio.

The golf tee 10 may further include one or more optional support rings 25 in the body 16 for adding additional strength to the tee 10.

In use, the tee 10 is placed on the ground and a golf ball is placed on the support rim 12. By having an open body 16, any grass that the tee 10 is placed on may simply nestle within the body 16 and even extend through the holes 20. This allows for a substantially level placement of the tee 10 on the ground even in the event of thick and/or longer grass.

It will be appreciated that the tee 10 may also be used on any hard surfaces, such as a gymnasium floor, artificial turf, garage, boat deck, ice, snow, etc., or a soft surface such as sand. A conventional tee is not suitable or usable for most of these surfaces. This allows a golfer to practice in a much broader range of locales and allows a golfer to play and practice with the same tee 10 or the same style of tee having varying heights.

Additionally, because the tee 10 has a high drag and a low weight to drag ratio as a result of the general lay-out of the body 16 of the tee 10, the tee 10 acts as a high drag projectile when struck by a swung golf club. This means that the tee 10 will tend to travel a shorter distance relative to prior golf tees when struck by a swinging golf club. This feature facilitates the finding of the golf tee. It results in fewer lost tees and therefore a lower replacement frequency. It may also speed up the round of golf as less time is spent finding a struck golf tee.

Tests have also shown that teeing up using the tee 10 can be up to three times faster than using a wooden tee or a zero friction tee or a brush tee. Less energy may be used to set up a tee 10 as it is not necessary to push the tee 10 into the ground. The ground can at times be harder and require more energy for a traditional tee to be pushed into the ground. This reduces the risk of injury to the golfer and removes the risk of breaking tees during setup or swinging of the golf club due to the hardness of the ground. This can be beneficial to golfers suffering from back problems, tendonitis, carpel tunnel syndrome, tennis elbow, or arthritic pain and discomfort. This can also be beneficial to very young beginner golfers or weaker older golfers. Tests have shown that a 4 year old can easily and quickly set up his own ball without any assistance.

A tee 10 as outlined above also ensures a consistent teeing up height each time the tee 10 is used thereby allowing for consistency of impact and therefore a possible improvement in golf score.

To further enhance the drag to weight ratio, the golf tee 10 may be made of light weight material, such as: nylon, mesh, cloth, any suitable plastic, etc.

Figure 2:
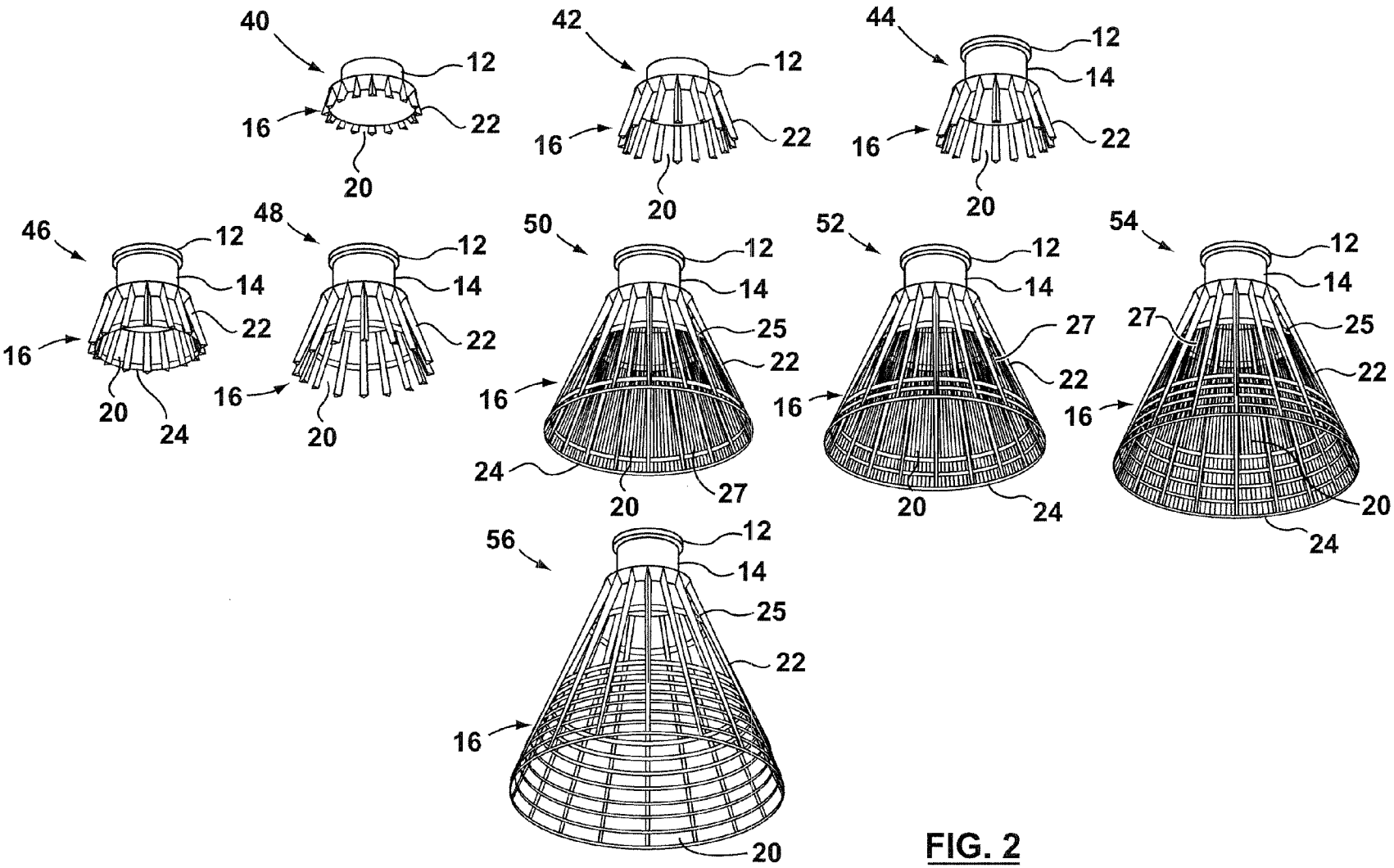
FIG. 2 is a perspective view illustrating one embodiment of a set of golf tees having a conical body.

In order to vary the height of the tee 10 so that a number of tee heights may be provided for a golfer, the tee 10 may be made with different heights. This can be accomplished for example by varying the height of either or both the optional neck 14 and the body 16. FIG. 2 illustrates an example of a set of tees 40, 42, 44, 46 48, 50, 52, 54, and 56, each having a different overall height. Each tee 40, 42, 44, 46 48, 50, 52, 54, and 56 has a different height so that a golfer has an option in selecting a desired teeing up height. It will be appreciated that because each tee has a conical open body 16, the tees 40, 42, 44, 46 48, 50, 52, 54, and 56 of the set are stackable which facilitates packaging and packing in a golf bag. As shown in FIG. 2, the tees may comprise webbing or mesh 27 to increase the surface area of the tee and thereby increase the amount of drag when the tee is struck. Tees 50, 52 and 54 illustrate varying amounts of mesh 27, while the remaining tees of FIG. 2 illustrate no mesh. It will be appreciated that the mesh 27 may extend up to the neck 14 or support rim 12 in the event that there is no neck 14. Further, even shorter tees such as 40, 42, 44, 46 and 48 may comprise some mesh to increase drag.

Figure 3:
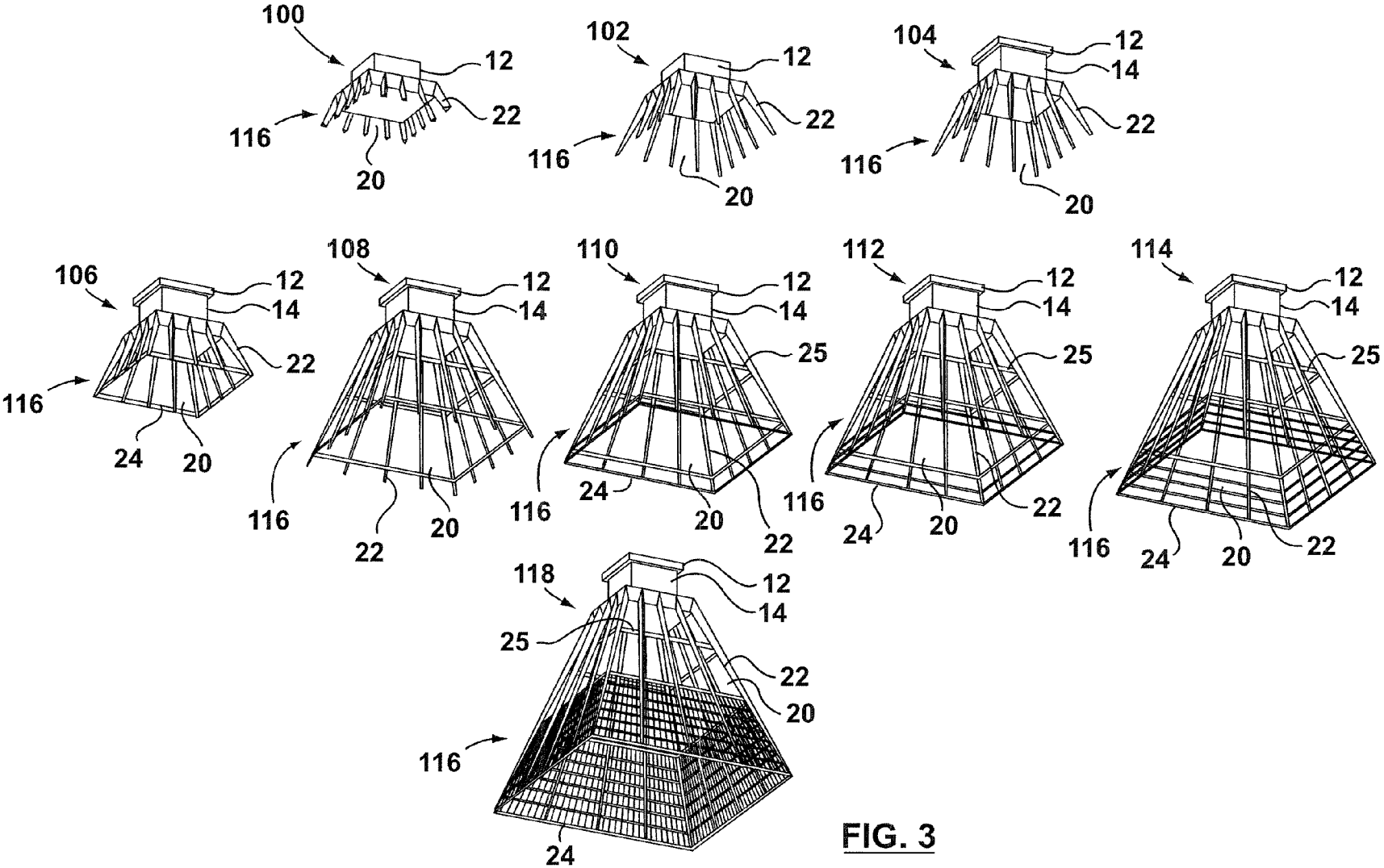
FIG. 3 is a perspective view illustrating one embodiment of a set of golf tees having a pyramidal body.

FIG. 3 illustrates an example of a set of tees for example 100, 102, 104, 106, 108, 110, 112, 114 and 118, each having a different overall height similar in concept to those shown in FIG. 2, however the body 116 of each tee has an open pyramidal shape. This embodiment illustrates that the tee is not restricted to a conical shape but may have any suitable open shape such as, a triangular pyramid, square pyramid, pentagonal pyramid or any other polyhedron. Each tee has a different height so that a golfer has an option in selecting a desired teeing up height. It will be appreciated that because each tee has a pyramidal open body 116, the tees of the set are stackable which facilitates packaging and packing in a golf bag. The tees illustrated in FIG. 3 may also optionally include additional mesh or webbing to increase drag of the tee.

Figure 4:
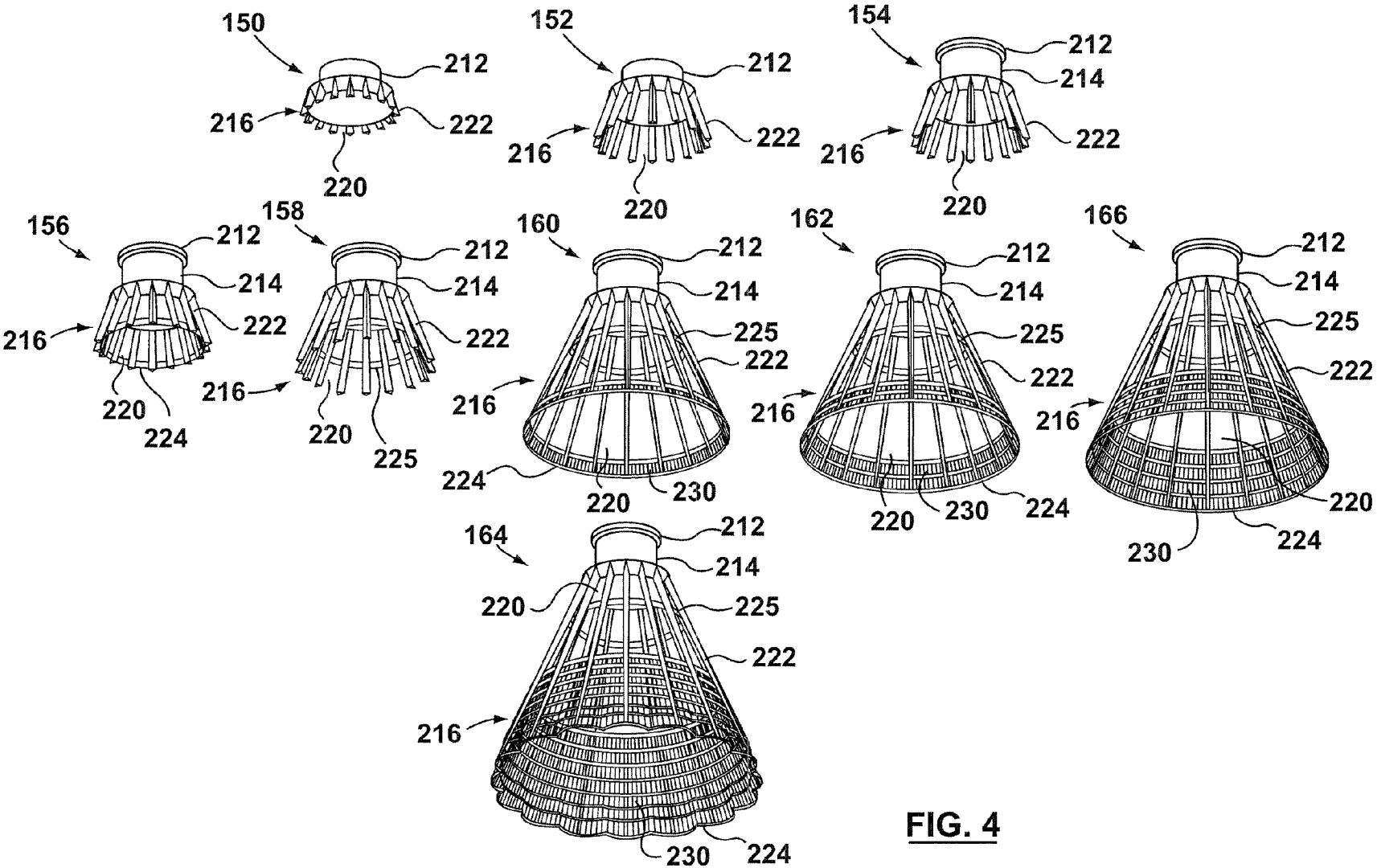
FIG. 4 is a perspective view illustrating one embodiment of a set of golf tees based on a shuttlecock.

FIG. 4 illustrates a golf tee shown generally as 164 which has been made using a recycled shuttlecock. As a shuttlecock is a high drag projectile it is a suitable shape and construction to be adapted for use as a golf tee. A shuttlecock may be adapted for use as a golf tee 164 by removing the elastomeric base, usually cork or rubber. The body of the shuttlecock may be cut to the desired length to form either a single tee or a plurality of shuttlecocks may be cut to different lengths to form a set of golf tees 150, 152, 154, 156, 158, 160, 162, 164 and 166 such as those illustrated in FIG. 4. The golf tees have a golf ball support rim 212 for supporting a golf ball. The tees also have a conical open body 216 comprised of support columns 222 and holes 220 as well as optional support rings 225. Golf tees 156, 160, 162, 166 and 164 also comprise an optional lower rim 224 upon which the tees are set on the ground for use in supporting a golf ball. Golf tees 154, 156, 158, 160, 162, 164 and 166 each comprise an optional neck 214 connecting the support rim 212 to the open conical body 216. The golf tees of FIG. 4 may rest substantially level even in dense or high grass and the grass may nestle within the open conical body 216 and can pass through the holes 220. The golf tees of FIG. 4 have a low weight as the original shuttlecock is typically made of plastic. The holes 220 serve to lower the weight of the tees and additionally provide for a surface area having a high drag.

Also contributing a high drag are the optional webbed regions 230. As a result, golf tees 150, 152, 154, 156, 158, 160, 162, 164 and 166 made from recycled shuttlecocks tend to travel a shorter distance relative to prior golf tee's when struck by a swinging golf club. This feature facilitates the finding of the golf tee. This results in fewer lost tees and therefore a lower replacement frequency. It may speed up the round of golf as less time is spent finding a struck golf tee. As outlined above with reference to FIG. 1, tees of the embodiments outlined above with reference to FIGS. 2, 3 and 4 may speed up the round of golf.

As illustrated in FIGS. 2 and 3, the golf tees 150, 152, 154, 156, 158, 160, 162, 164 and 166 illustrated in FIG. 4 may have varying heights thereby allowing for a golfer to select a tee of a desired height to support the golf ball.

In order to more easily identify the heights of each tee, for example those illustrated in FIGS. 2, 3 and 4, the tee may include an indicia (not shown) indicating the height. Such indicia may be in the form of a colour, a number, a height measurement, etc. A single tee may include more than one indicia, for example both a coloured support rim and a number.

It has been found that a golf tee 10 as described above is very robust and may be used a plurality of times and over many rounds of golf without requiring replacement. Furthermore, as a golf tee having a higher height becomes worn through extensive use, it has been observed that the part of the tee which tends to wear more quickly is the lower end. Because it is the lower end which tends to wear first, the worn lower end may be trimmed off resulting in a usable tee having a reduced height. This allows for continued use of the tee as a tee with a lower height in a set of golf tees. The continued use of the reduced height tee also helps the reduction of pollution caused by broken tees on the golf course.

It has been observed that a single golf tee having a general construction such as that outlined above with reference to FIGS. 1-4 has been usable for over 35 rounds of golf without replacement.

Golf tees as disclosed above may range for example in heights starting from 0.25 inches and increasing by, for example consistent increments, of 0.25 inches. Although there is no maximum height limit, the tallest tee may be equal to or shorter than the standard permitted by the professional rules of golf.

The tee as disclosed above may also or alternatively be marked to indicate an appropriate golf club for use with a particular tee of a particular height.

In one embodiment, the golf tee may be formed from one piece of light weight material such as nylon, mesh, cloth, or any suitable plastic.

The golf tees outlined above may have different colours, such as a reflective colour or glow-in-the-dark plastic so that they are more easily found and also usable in the dark, for example in snow golf or night golf.

In one embodiment, the support rim 12 may be comprised of at least three support points for contacting and supporting a golf ball as opposed to a flat rim, wherein the golf ball contacts the rim all along the rim.

The golf tees may additionally be made of more than one material. For example, the supporting column, support rim and neck may be made from plastic and optional mesh may be made from an alloy used for making screens. Alternatively, the tee may be made from an elastomeric material such as rubber.

Due to the high drag characteristics of the golf tee outlined above, the tee may also be used as an effective gauge of wind velocity. The tee may be tossed into the air and the velocity of the wind may be substantially determined based on the direction and distance traveled by the tee before hitting the ground.

Basic testing has shown that dropping a tee such as 166, 54 or 114 from a height of approximately six feet in a wind of about 20 km/h (12 mph) results in about a 1 foot deviation on landing. An equivalent drop in a wind of about 10 km/h (6 mph) results in about a 6 inch deviation on landing. Based on a determined wind speed, a golfer may compensate accordingly by changing the aim, club and/or style of swing to obtain a better result. Other tests have shown that a head wind of about 20 km/h will result in a loss of approximately 15 yards on a 250 yard drive or a gain of approximately 10 yards with a tail wind.

Also contemplated, is a recycling project which may be carried out for example in schools or at home. The recycling project adds recreation to the already known three R's thus creating the innovation of the 4 R's: reducing, reusing, recycling and recreation. The conversion of old badminton shuttlecocks into golf tees as described above allows for the recycling of shuttlecocks, the reusing of the converted shuttlecock and the reduction of pollution of the golf course caused by broken conventional golf tees.

Such a recycling project may be implemented in a school to promote recycling and innovation. The converted golf tees could then be used to encourage recreation. This is a valuable aspect as some school boards have implemented mandatory physical fitness on a daily basis during school.

The present invention has been described with regard to a plurality of illustrative embodiments. However, it will be apparent to persons skilled in the art that a number of variations and modifications can be made without departing from the scope of the invention as defined in the claims.

That which is claimed is:

1. A one-piece golf tee kit comprising:

a plurality of stackable one-piece golf tees each having a different height, each golf tee comprising:

a support rim for supporting a golf ball;

an open body having a lower end for supporting the golf tee and an upper end for supporting the support rim, the open body comprising:

a plurality of support columns, each support column having an upper end and a lower end; and at least one support ring transversely connecting each support column of the plurality of support columns to at least another of the support columns at a lower end of the support columns; and a neck connecting the open body with the support rim;

wherein the open body defines a plurality of holes thereby reducing the weight of the golf tee, and the plurality of support columns and the at least one support ring increase the surface area of the golf tee thereby increasing drag on the golf tee; and wherein the open body of each golf tee is adapted so that a golf tee having a smaller height is stackable within the open body; and wherein each successively stackable golf tee has at least one less support ring between the lower end and the upper end of the golf tee than the golf tee upon which it is stackable.

2. The golf tee kit of claim 1, wherein each golf tee comprises indicia for differentiating each golf tee.

3. The golf tee kit of claim 2, wherein the indicia is selected from the group consisting of a coloured support rim, a number, a coloured marking and a measurement.

4. The golf tee kit of claim 1, wherein the support rim is comprised of at least three support points for contacting and supporting a golf ball.

5. The golf tee kit of claim 1, wherein the difference in height of each golf tee is equal.

6. The golf tee kit of claim 1, wherein the difference in height of each golf tee is ¼ inch.

* * * * *